US007179319B2

(12) United States Patent
Heinrich et al.

(10) Patent No.: US 7,179,319 B2
(45) Date of Patent: Feb. 20, 2007

(54) FINE GRAINED SINTERED CEMENTED CARBIDE, PROCESS FOR MANUFACTURING AND USE THEREOF

(75) Inventors: Hans-Wilm Heinrich, Bayreuth (DE); Dieter Schmidt, Bayreuth (DE); Manfred Wolf, Eckersdorf (DE)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/759,478

(22) Filed: Jan. 16, 2004

(65) Prior Publication Data

US 2004/0187638 A1 Sep. 30, 2004

Related U.S. Application Data

(63) Continuation of application No. PCT/IB02/02384, filed on Jun. 21, 2002.

(51) Int. Cl.
*C22C 29/08* (2006.01)

(52) U.S. Cl. ..... 75/236; 75/239; 75/240; 75/241; 75/242; 428/545; 51/307

(58) Field of Classification Search ..... 75/238, 75/242, 236, 239, 240, 241; 51/307; 428/545
See application file for complete search history.

(56) References Cited

U.S. PATENT DOCUMENTS

| | | | | |
|---|---|---|---|---|
| 3,451,791 | A * | 6/1969 | Meadows | 428/568 |
| 3,480,410 | A * | 11/1969 | Hummer | 75/240 |
| 5,009,705 | A * | 4/1991 | Yoshimura et al. | 75/240 |
| 5,918,102 | A | 6/1999 | Friederichs | |
| 6,027,808 | A * | 2/2000 | Aoki et al. | 428/408 |
| 6,207,262 | B1 * | 3/2001 | Ichikawa et al. | 428/216 |
| 6,228,139 | B1 * | 5/2001 | Oskarsson | 75/240 |

FOREIGN PATENT DOCUMENTS

| | | |
|---|---|---|
| DE | 40 00 223 C2 | 7/1993 |
| EP | 1 054 071 A2 | 11/2000 |

OTHER PUBLICATIONS

Egami et al., "Ultra Submicron Hardmetals for Miniature Drills", Plansee Seminar 89', vol. 2, pp. 53-70 12th Int'l Plansee Seminar.
Egami et al., "Morphology of Vanadium Carbide in Submicron Hardmetals", 13th Intl' Plansee Seminar, vol. 3 pp. 639-648 (1993).
G. Gille,et al., "A new 0.4 UM WC powder as well as powder-related properties and sintering behavior of of 0.6 to 30 um WC—Co hardmetals", Proceedings of the 14th Int'l Plansee Seminar AG Reutte (1997) vol. 2 pp. 139-167 HM12.
D. F. Carroll, "Processing and Properties of Ultrafine WC/Co Hard Metals", Dow Chemical Co., Proceedings of 14th Int'l Plansee Seminar, AG Reutte, (1997) vol. 2 pp. 168-182 HM14.
J. Zackrisson et al., "WC—Co Based Cemented Carbides with Large Cr3C2 Addidtions", Int'l Journal of Refractory Metal & Hard Metals 16(1998)pp. 417-422.
Opposition by Sandvik AB against De 101 35 790 in German language (Oct. 14, 2005).

* cited by examiner

*Primary Examiner*—Ngoclan T. Mai
(74) *Attorney, Agent, or Firm*—Larry R. Meenan

(57) ABSTRACT

The invention proposes a fine grained sintered cemented carbide containing chromium and based on WC and a binder based on Co or CoNiFe, and having at least one additional phase comprising at least one carbide or mixed carbide of tantalum. For improving the high-temperature properties while simultaneously maintaining a good trade-off between hardness and bending strength, it is proposed that the sintered cemented carbide contains approximately 0.3 to 4% Ta, as related to the total mass of the sintered cemented carbide, that the WC has a grain size of between 0.1 and 1.3 μm, that the binder phase contains the metals W, Cr and Ta, dissolved in solid solution, and that the at least one additional phase comprises a TaC phase visible by optical microscopy. The invention further relates to a powder-metallurgical process for manufacturing the sintered cemented carbide and to the use of the sintered cemented carbide for manufacturing cutting tools having improved high-temperature properties.

23 Claims, 3 Drawing Sheets

Figure 1:
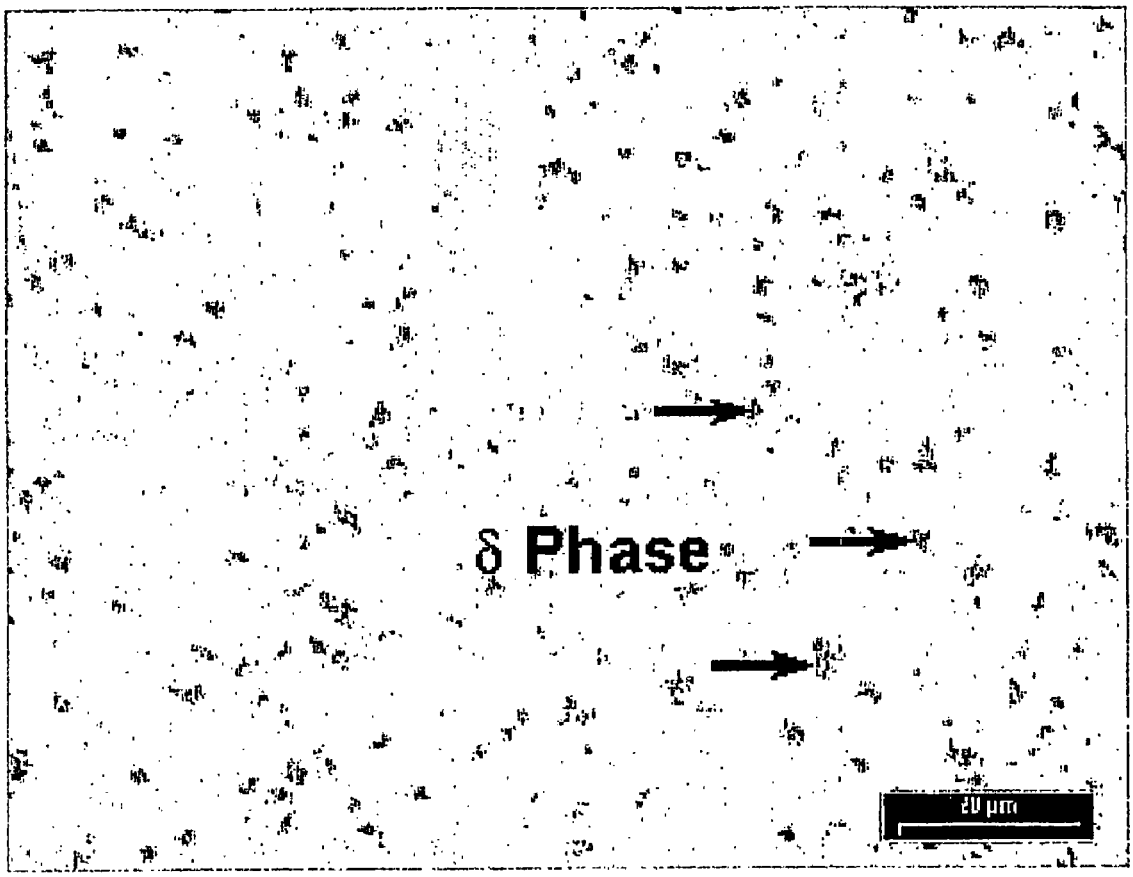

FINE GRAINED SINTERED CEMENTED CARBIDE, PROCESS FOR MANUFACTURING AND USE THEREOF

CONTINUING APPLICATION DATA

This patent application is a Continuation application of International Patent Application No. PCT/IB02/002384 filed on 21 Jun. 2002, which claims priority from Federal Republic of Germany Patent Application No. 101 35 790.7 filed on 23 Jul. 2001. International Patent Application No. PCT/IB02/002384 was pending as of the filing date of this patent application. The United States of America was an elected state in International Patent Application NO. PCT/IB02/002384.

BACKGROUND OF THE INVENTION

The invention relates to a fine grained sintered cemented carbide containing chromium, consisting of a first phase based on tungsten carbide (WC) which is bound by means of a second phase of a metallic binder based on Co or CoNiFe, and of at least one additional phase comprising at least one carbide or mixed carbide of tantalum.

Polyphase cemented carbides of this type have been known for a long time, the cemented carbide grades being distinguished according to the compromise between physical properties selected to vary depending on the particular intended use (hardness, bending strength, pressure resistance, modulus of elasticity). Accordingly, the cemented carbides are classified according to the international standard ISO/Tc29 into the P, M and K grades suitable for metal cutting purposes and the G grades preferably used for non-cutting shaping and parts subject to wear, which have different binder metal contents and different additional carbide contents, in addition to tungsten carbide as the main constituent. The harder a cemented carbide grade, the better its wear resistance, but the worse its bending strength.

In cemented carbides for metal cutting purposes, the quality of a cemented carbide grade is dictated quite substantially by its high-temperature properties. The hardness of the cemented carbides is in some cases reduced dramatically as temperature rises, while noxious scaling and diffusion processes increase at the same time, and the deformation behavior of cutting inserts or other bodies made from the cemented carbide likewise changes drastically.

A simple WC—Co cemented carbide having a cobalt content of about 10%, for example, will feature only about one third of its hardness at 800° C. compared with its hardness at room temperature, whereas a P10 cemented carbide containing additions of TiC and (Ta, Nb)C will still feature about half of its hardness compared with that at room temperature.

Finally, the mechanical properties of the sintered cemented carbides are affected by the way of their powder-metallurgical manufacture. Grain growth is almost impossible to avoid during sintering and hot isostatic pressing (HIPping) of the corresponding green compacts and has a negative effect on the bending strength of the sintered cemented carbide. Therefore, specific carbides are admixed to the starting powder blend as grain growth inhibitors. The most frequently used grain growth inhibitors are carbides of tantalum, chromium and vanadium, with tantalum carbide being usually employed as (Ta, Nb)C mixed carbide, owing to the natural association of the metals tantalum and niobium and for reasons of cost. The effectiveness of the three aforementioned commonly used grain growth inhibitors increases in the order mentioned, from Ta via Cr to V.

The complexity of the process sequences in cemented carbide manufacturing is still further increased in that both tungsten from the tungsten carbide and the metals of the grain growth inhibitors diffuse into the binder phase and dissolve therein to form a solid solution. Since the solubility of these metals in the binder metal is of course higher at higher temperatures than at room temperature, the solubility, that is, the maximum dissolved concentration at a particular temperature, can be exceeded, whereby the excessive amount which is no longer soluble precipitates out of the binder phase again or is deposited on the surface of the WC grains. Such deposition, however, impairs the wetting of the grains with the binder metal, which in turn results in a deterioration in the bending strength. A person of ordinary skill in the art thus has been and still is aware that only very small amounts of grain growth inhibitors should be utilized so as to achieve as good a compromise as possible between a prevention of grain growth during sintering and a deterioration of the wetting of the WC grains with binder metal.

Another technique at first suggesting itself for counteracting grain growth consisted in using finer starting powders from the outset, i.e. the use of fine (0.8 to 1.3 μm), submicron (0.5 to 0.8 μm), ultrafine (0.2 to 0.5 μm) or even nano particles (<0.2 μm), rather than coarse (2.5 to 6.0 μm) or medium coarse particles (1.3 to 2.5 μm), for the manufacture of the starting powder blend, even though the powders become more expensive as they increase in fineness, causing additional difficulties in handling and in producing the green compacts. Use of finer starting particles would obviate part of the grain growth inhibitors. This path was followed, in different ways, by U.S. Pat. No. 5,918,102 and German Patent 40 00 223.

According to U.S. Pat. No. 5,918,102 a powder blend of ultrafine WC and 6 to 15 wt. % binder metal is used, which is mixed with up to about 1 wt. % of grain growth inhibitors in the form of one or more of the carbides TiC, TaC, NbC, HfC, ZrC, $Mo_2C$ and VC.

German Patent 40 00 223 describes a microdrill made from a cemented carbide based on WC and Co, which is intended for producing submicron size holes in circuit boards and is manufactured from submicron tungsten carbide powder having an average particle size of 0.6 μm and having added thereto 4 to 10 wt. % (Cr+V), as related to the total weight of the binder alloy based on cobalt, because the authors of this printed publication have found that the grain growth of tungsten carbide can be more effectively prevented by the addition of such an amount of V and Cr than by an addition of tantalum carbide.

It turned out, however, that the cemented carbide grades mentioned in the two patents are not so suitable for metal cutting purposes, in particular for the cutting of steel, because they do not have the necessary high temperature properties (high temperature hardness, resistance to scaling and diffusion, wear characteristics in the cutting test).

DETAILED DESCRIPTION

The object of the invention is therefore to provide novel, fine grained and at the same time corrosion-resistant sintered cemented carbide grades having improved high temperature properties, in particular having improved wear characteristics in the metal cutting test, which may be employed for all kinds of metal cutting purposes and used in particular for the manufacture of cutting inserts and other cutting tools, but also for the manufacture of heavily stressed parts subject to wear, such as, e.g., rollers.

This object is achieved in accordance with the invention by a fine grained sintered cemented carbide containing chromium, consisting of a first phase based on tungsten carbide (WC) which is bound by means of a second phase of a metallic binder based on Co or CoNiFe, and of at least one additional phase comprising at least one carbide or mixed carbide of tantalum, wherein the sintered cemented carbide contains approximately 0.3 to 4% Ta, as related to the total mass of the sintered cemented carbide, the WC has a grain size of between 0.1 and 1.3 μm, the binder phase contains the metals W, Cr and Ta, dissolved in solid solution, and the at least one additional phase comprises a TaC phase visible by optical microscopy.

The applicants have surprisingly succeeded in providing, for the first time, a fine grained sintered cemented carbide containing chromium, in which a good trade-off between hardness and bending strength is attained by an effective suppression or restriction of grain growth, on the one hand by the addition of a grain growth inhibitor known per se, namely TaC or (Ta,Nb)C, and on the other hand by the use of a fine, submicron and/or ultrafine tungsten carbide powder, and in which furthermore the solubility of the tantalum in the binder phase at room temperature is exceeded by the addition of tantalum in relatively large amounts of up to approximately 4 mass-% in the presence of chromium at the same time, so that an additional phase precipitates which comprises a TaC phase visible in the sintered cemented carbide by optical microscopy. The saturation of the binder phase with Ta and the simultaneous presence of chromium in the solid solution of the binder phase, and the precipitation of the additional TaC phase in the form of a discrete phase visible by optical microscopy, improve the deformation behavior, the resistance to scaling and diffusion and, above all, the high temperature properties of the cemented carbide in accordance with the invention and the shaped bodies produced therefrom to such an extent that, unlike the grades disclosed in German Patent 40 00 223 and U.S. Pat. No. 5,918,102, the cemented carbide grades in accordance with the invention may even and in particular be utilized for metal cutting purposes where extremely high temperatures and heavy thermal shock stresses can occur. This considerably broadens the previously known ranges of application of submicron and ultrafine sintered cemented carbides in the field of metal cutting, something which is totally surprising among expert circles in view of the prior art.

In the process in accordance with the invention for manufacturing the sintered cemented carbide, preferably in the form of a three-dimensional body, for instance a cutting insert, fine, powdery starting materials including WC as a main constituent, Co or CoNiFe as a binder and compounds of Cr and Ta as well as, optionally, V and/or Nb, are ground in a ball mill or an attrition mill with the addition of carbon or tungsten and conventional grinding and/or sintering aids, compressed to form a green compact of the desired shape, and subsequently sintered and, optionally, provided with a hard, wear-resistant coating, wherein only submicron and ultrafine tungsten carbide grades having grain sizes of between approximately 0.1 and 0.8 μm are used, and wherein Cr and Ta and, optionally, V and/or Nb are added to the powder blend in amounts so as to exceed the solubility of these metals in the binder phase at room temperature.

The solubility of the tantalum in the binder phase at room temperature is already exceeded at approximately 0.3%, as related to the total mass of the sintered cemented carbide. From this results the lower limit of the claimed tantalum content. The upper limit of approximately 4% tantalum should not be exceeded because otherwise there is the risk of structural changes occurring in the sintered cemented carbide which can again impair the good high temperature properties of the sintered cemented carbide.

The best results could be achieved with a tantalum content of approximately 0.8 to 1.2%, as related to the total mass of the sintered cemented carbide.

In order to reduce costs it is advantageous to use a tantalum in which up to 50 mass-% are replaced by niobium. In this case the binder phase based on Co or CoNiFe contains not only tantalum, aside from the metals W and Cr, but also niobium dissolved in solid solution, and the at least one additional phase then further comprises a (Ta, Nb)C phase visible by optical microscopy, in addition to the TaC phase. Accordingly, the sintered cemented carbide in accordance with the invention may contain up to approximately 2% Nb, preferably approximately 0.4 to 0.6% Nb, as related to the total mass of the sintered cemented carbide.

According to the invention, the WC grains in the sintered cemented carbide have a grain size of between 0.1 and 1.3 μm, preferably between approximately 0.3 and 0.6 μm. Up to 3 mass-% of the tungsten carbide may be replaced by at least one hard component which is selected from the carbides, nitrides, carbonitrides, including their mixtures and solid solutions, of the metals titanium, zirconium, hafnium and molybdenum.

For manufacturing the sintered cemented carbides in accordance with the invention, it is also possible to advantageously use such commercially available WC grades which are doped with one or more grain growth inhibitors, such as with chromium carbide ($Cr_3C_2$) and/or with vanadium carbide (VC), for example. The use of such WC grades which contain up to 0.6 wt. % $Cr_3C_2$ and/or up to 0.4 wt. % VC is particularly preferred.

In the sintered cemented carbide in accordance with the invention the binder phase preferably accounts for approximately 3 to 18% of the total mass of the sintered cemented carbide. A content above 18% will be at the expense of the hardness and a content below approximately 3% will cause a decrease in the bending strength of the sintered cemented carbide.

The binder phase may contain up to 20% tungsten, as related to its mass and dissolved in solid solution. The chromium content of the sintered cemented carbide preferably amounts to approximately 1 to 40%, as related to the total mass of the binder phase. Particularly preferred is a chromium content in the range of approximately 6 to 12% and in the range of approximately 17 to 30%, each as related to the total mass of the binder phase. If the chromium content is within the window of approximately 6 to 12%, no additional (Cr, Co)-rich mixed carbide phase will form in the sintered cemented carbide according to the invention, whereas on the other hand, if the chromium content is within the window between approximately 17 and 30%, an additional (Cr, Co)-rich mixed carbide phase will form, with the fracture toughness values being high within both of the chromium content windows. Surprisingly, the bending strength drops sharply in the range in between, above 12% and below 17% chromium, for reasons lacking an explanation to date. The high temperature properties of the sintered cemented carbide, however, are better over the entire range than those of the known fine to ultrafine sintered cemented carbides.

One particularly preferred embodiment of the sintered cemented carbide in accordance with the invention additionally contains up to 8% vanadium, as related to the total mass of the binder phase, more particularly preferred at least 2% V. In this case the binder phase additionally contains vanadium dissolved in the solid solution consisting of cobalt and the other aforementioned metals or of CoNiFe and the aforesaid metals.

When the solubility of vanadium in the binder phase at room temperature is exceeded, further phases precipitate which are visible by optical microscopy: the at least one additional phase will then comprise at least one of the phases (Ta, V)C and (Ta, Nb, V)C.

According to the invention, it is basically preferred here that the metals dissolved in the binder phase, with the exception of tungsten, are dissolved in the binder phase in an amount corresponding to their respective solubility in the binder phase at room temperature, that is, to their respective maximum concentration under the given circumstances and at room temperature. Only the percentage of the tungsten dissolved in the binder phase is preferably limited to a maximum of 20%, as related to the total mass of the binder phase.

The porosity of the sintered cemented carbide in accordance with the invention is preferably below the A 02 degree.

The sintered cemented carbide in accordance with the invention is preferably provided with a hard, wear-resistant coating which is applied by physical or chemical vapor deposition (PVD or CVD) and, as with known sintered cemented carbide grades, usually consists of one or more layers of TiC, TiN, TiCN, TiAlN and/or $Al_2O_3$, for example.

In the manufacture of the sintered cemented carbides according to the invention the metals chromium and tantalum and, optionally, vanadium and/or niobium are added to the starting powder blend preferably individually or in solid solution in the form of carbides and/or oxides.

The amount of carbon or tungsten to be added to the starting powder blend is known and familiar to those skilled in the present field since the product of W and C in the cobalt-rich mixed crystal of the binder phase always remains constant. The amounts to be added are to be selected so as to form neither a brittle i-phase nor free carbon.

The cemented carbide in accordance with the invention is preferably employed for the production therefrom of cutting tools comprising a rake face and a flank face and comprising a cutting edge at the intersection of the rake face and the flank face, particularly preferably in the form of a drill, a bit, a milling cutter or a part of such tools, or in the form of a cutting insert or an indexable insert. But the sintered cemented carbide grades in accordance with the invention can also be used to particular advantage for the manufacture of tools for non-cutting shaping and parts subject to wear, such as rollers and cylinders.

Accordingly, the invention comprises, inter alia, the following embodiments of a fine grained sintered cemented carbide containing chromium and tantalum:

Group I

Hard component combination employed: $WC+Cr_3C_2+TaC$

Binder phase: W+Cr+Ta, dissolved in Co or in CoNiFe, with Ta and Cr being dissolved up to their respective limit of solubility at room temperature Additional phase visible by optical microscopy: TaC Group II Hard component combination employed: $WC+Cr_3C_2+$ (Ta, Nb)C or TaC+NbC Binder phase: W+Cr+Ta+Nb, dissolved in Co or CoNiFe, with Ta, Nb and Cr being dissolved up to their respective limit of solubility at room temperature Additional phase visible by optical microscopy: TaC+(Ta, Nb)C Group III Hard component combination employed: $WC+Cr_3C_2+TaC+VC$ Binder phase: W+Cr+Ta+V, dissolved in Co or CoNiFe, with Ta, Cr and V being dissolved up to their respective limit of solubility at room temperature Additional phase visible by optical microscopy: TaC+(Ta, V)C Group IV Hard component combination employed: $WC+Cr_3C_2+VC+$(Ta, Nb)C or TaC+NbC Binder phase: W+Cr+Ta+Nb+V, dissolved in Co or CoNiFe, with Ta, Nb, Cr and V each being dissolved up to their limit of solubility at room temperature Additional phase visible by optical microscopy: TaC+(Ta, V)C+(Ta, Nb, V)C Groups V through VIII As with Groups I through IV, but each comprising a further additional phase of (Cr, Co)-rich $M_xC_y$ carbides visible by optical microscopy Groups IX through XVI As with Groups I through VIII, but comprising an additional content of up to 3 mass-%, as related to the mass of the tungsten carbide, of at least one hard component which is selected from the carbides, nitrides, carbonitrides, including their mixtures and solid solutions, of the metals Ti, Zr, Hf and Mo.

The grain sizes and quantitative ratios as indicated in the claims apply to all of these embodiments.

Figure 2:
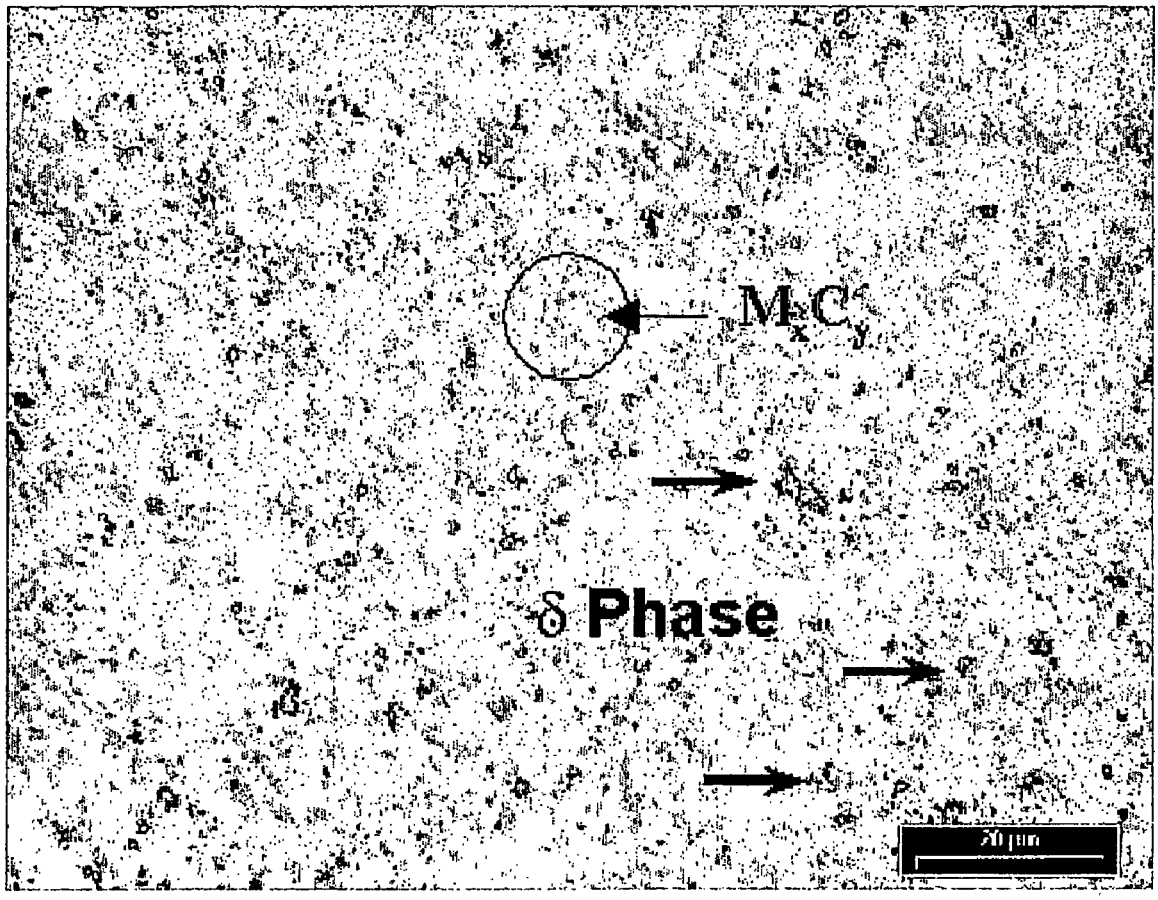

The invention will be explained in greater detail below with reference to micrographs, charts and embodiments:

FIGS. 1 and 2 are photographs of optical microscopy magnifications (200 times) of etched microsections of embodiments of the sintered cemented carbide in accordance with the invention, which show the formation of at least one additional phase of (Ta, V)C and/or (Ta, Nb, V)C, visible by optical microscopy, termed "δ-phase" here, and the uniform distribution thereof over the cross-section of the sintered cemented carbide.

In addition to the δ-phase, the development of a phase of (Cr, Co)-rich mixed carbides of the general formula $M_xC_y$ can be best seen in FIG. 2.

Figure 3:
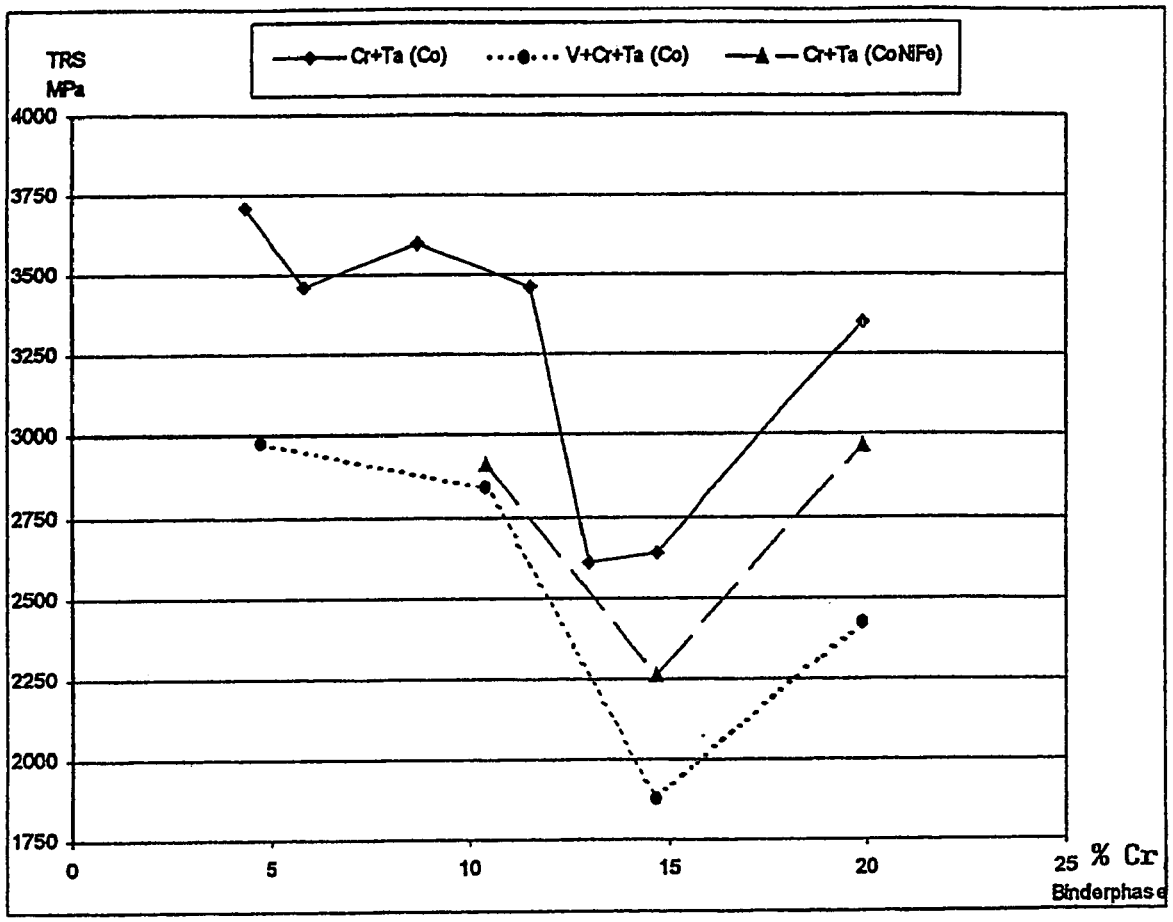

FIG. 3 is a chart showing the bending strength (TRS), measured in MPa (ordinate), of the sintered cemented carbide, as plotted against the chromium content of the binder phase, given in mass-% (abscissa), for three different sintered cemented carbide grades in accordance with the invention, having differing binder phases, namely, (1) Cr+Ta dissolved in Co up to their limit of solubility at room temperature, (2) V+Cr+Ta dissolved in Co up to their limit of solubility at room temperature, and (3) Cr+Ta dissolved in CoNiFe up to their limit of solubility at room temperature.

The astonishing profiles of the three graphs of FIG. 3 reveal that a chromium content of between approximately 12 and 17 mass-% results in bending strengths which are significantly lower than the bending strengths both for chromium contents of <12% and also for chromium contents of >17%. Proceeding from the limits of the aforecited window, the bending strengths surprisingly rise sharply in both directions, both in the direction of lower chromium contents and in the direction of higher chromium contents.

Although the binder alloys which, besides the binder metal cobalt or CoNiFe, contain only chromium and tantalum, and the binder alloy which additionally contains vanadium in solid solution (with up to 50 mass-% of the tantalum being replaceable by niobium in all cases), in principle behave similarly when there is a change in the chromium content, FIG. 3 directly teaches that the binder phase containing vanadium is at a distinctly lower level with regard to the values attained for the bending strength. For this reason, according to the invention chromium contents of ≧17 mass-% are preferred for those cemented carbide grades in accordance with the invention which, aside from chromium, only contain tantalum and, optionally, niobium, whereas chromium contents of ≦12 mass-% are preferred for those cemented carbide grades which, in addition to chromium. contain tantalum and vanadium and, optionally, niobium. The presence of an additional (Cr, Co)-rich mixed carbide phase $M_xC_y$ as can be seen in FIG. 2, or the absence of such (Cr, Co)-rich mixed carbide phase $M_xC_y$, as can be seen in FIG. 1, appears to have no impact on the profiles of the TRS/chromium content curves, irrespective of whether or not the sintered cemented carbide additionally contains vanadium.

Finally, it has been found that the cemented carbide grades in accordance with the invention which do not contain vanadium, reach their maximum hardness values with chromium contents of more than 13 mass-%, while cemented carbide grades which in addition contain vanadium reach their maximum hardness values with chromium contents of less than 8 mass-%.

For manufacturing the sintered cemented carbides in accordance with the invention the powdery raw materials as specified below were used.

| Raw material | Manufacturer | Average grain size |
|---|---|---|
| Co | OMG | 1.3 μm |
| VC | H. C. Starck | 1.3 μm |

-continued

| Raw material | Manufacturer | Average grain size |
|---|---|---|
| $Cr_3C_2$ | H. C. Starck | 1.5 μm |
| $Ta_2O_5$ | H. C. Starck | <1.0 μm |
| TaC | Kennametal | 1.2 μm |
| (Ta,Nb)C | Kennametal | 1.2 μm |
| $WC^1$ | H. C. Starck | 0.4 μm |
| $WC^2$ | H. C. Starck | 0.4 μm |
| $WC^3$ | WBH | 0.6 μm |
| $WC^4$ | Dow Chemical | 0.8 μm |

$WC^1$: doped with 0.4 wt. % VC, 0.6 wt. % $Cr_3C_2$
$WC^2$: undoped
$WC^3$: doped with 0.4 wt. % VC, 0.6 wt. % $Cr_3C_2$
$WC^4$: undoped In all of the following examples the raw materials were wet ground in an attrition mill or a ball mill for 12 hours and subsequently spray dried. The ground and spray dried powder blends were then pressed to form green compacts of tools having the respective geometry as indicated. The green compacts were sintered at a temperature of approximately 1420° C. for 60 min.; all sintered cemented carbides attained a porosity of <A02. After allowing the shaped sintered cemented carbide bodies to cool to room temperature, the high temperature properties of the sintered cemented carbides obtained were determined with the aid of conventional high temperature hardness tests (metal cutting tests).

Furthermore, the Vickers hardness (HV30), the coercive force and the bending strength of the cemented carbide grades in accordance with the invention and those of a few known cemented carbide grades were determined and compared with each other. Table 1 below specifies the compositions of the analyzed cemented carbide grades with the physical and mechanical properties measured in each case, with the powder blends A through H, J through P, R through U, W and Y corresponding to cemented carbide grades in accordance with the invention while the powder blends I, Q, V and X are blends resulting in known cemented carbide grades.

TABLE 1

| Powder blend | WC type | Co wt % | VC wt % | $Cr_3C_2$ wt % | Cr % of binder phase | $Ta_2O_5$ wt % | TaC wt % | NbC wt % | Hc [Oe] | hardness (HV30) | TRS [MPa] |
|---|---|---|---|---|---|---|---|---|---|---|---|
| A | 2 | 10 | | 0.5 | 4.3 | 1.5 | | | 307 | 1700 | 3710 |
| B | 2 | 10 | | 0.67 | 5.8 | 1.66 | | | 295 | 1680 | 3460 |
| C | 2 | 10 | | 0.67 | 5.8 | | 1.33 | | 305 | 1690 | 3340 |
| D | 2 | 10 | | 1 | 8.7 | 1 | | | 303 | 1690 | 3600 |
| E | 2 | 10 | | 1.33 | 11.5 | 0.67 | | | 311 | 1710 | 3460 |
| F | 2 | 10 | | 1.5 | 13 | 0.5 | | | 306 | 1700 | 2610 |
| G | 2 | 10 | | 1.7 | 14.7 | 1.2 | | | 356 | 1760 | 2640 |
| H | 2 | 10 | | 2.3 | 19.9 | 2.4 | | | 361 | 1760 | 3350 |
| $I^x$ | 1 | 10 | 0.36 | 0.54 | 4.7 | | | | 360 | 1700 | 3820 |
| J | 1 | 10 | 0.36 | 0.54 | 4.7 | 1.2 | | | 440 | 1780 | 2980 |
| K | 1 | 10 | 0.36 | 0.54 | 4.7 | | 1 | | 440 | 1780 | 2830 |
| L | 1 | 10 | 0.36 | 0.54 | 4.7 | | 0.7 | 0.3 | 461 | 1800 | 2920 |
| M | 1 | 10 | 0.36 | 0.54 | 4.7 | 3 | | | 430 | 1780 | 3120 |
| N | 1 | 10 | 0.36 | 1.2 | 10.4 | 1.2 | | | 470 | 1860 | 2840 |
| O | 1 | 10 | 0.36 | 1.7 | 14.7 | 1.2 | | | 434 | 1820 | 1880 |
| P | 1 | 10 | 0.36 | 2.3 | 19.9 | 1.2 | | | 446 | 1840 | 2420 |
| $Q^x$ | 1 | 12.5 | 0.35 | 0.53 | 3.6 | | | | 280 | 1540 | 4290 |
| R | 1 | 12.5 | 0.35 | 0.53 | 3.6 | 1.2 | | | 336 | 1620 | 3320 |
| S | 2 | $10^1$ | | 1.2 | 10.4 | 1.2 | | | 292 | 1690 | 2910 |
| T | 2 | $10^1$ | | 1.7 | 14.7 | 1.2 | | | 320 | 1740 | 2260 |
| U | 2 | $10^1$ | | 2.3 | 19.9 | 1.2 | | | 309 | 1700 | 2970 |
| $V^x$ | 1 | 9.5 | 0.36 | 0.54 | 5.5 | | | | 385 | 1760 | 3600 |
| W | 1 | 9.5 | 0.36 | 0.54 | 5.5 | 3 | | | 444 | 1830 | 2990 |

TABLE 1-continued

| Powder blend | WC type | Co wt % | VC wt % | $Cr_3C_2$ wt % | Cr % of binder phase | $Ta_2O_5$ wt % | TaC wt % | NbC wt % | Hc [Oe] | hardness (HV30) | TRS [MPa] |
|---|---|---|---|---|---|---|---|---|---|---|---|
| X[x] | 3 | 9.5 | 0.36 | 0.54 | 5.5 | | | | 352 | 1700 | — |
| Y | 4 | 9.5 | 0.36 | 0.54 | 5.5 | 3 | | | 293 | 1680 | — |

[x]prior art
[1]CoNiFe binder with 60% Co, 20% Ni and 20% Fe
HV = Vickers hardness
Hc = coercive force
TRS = bending strength
wt % = %, as related to the total mass

EXAMPLE 1

Cutting inserts of the SPGN 120308F geometry were made from the X and Y powder blends and were subjected to a metal cutting test under the following conditions:

Material of the workpiece to be cut: C45 steel

Cutting speed: 100 m/min.

Feed rate: 0.15 mm/revolution

Depth of cut: 1.0 mm

Coolant: none

Result: The tool life of the cutting insert made from the X powder blend (prior art) amounted to 6.4 min. until a maximum possible wear of the flank face of 0.25 mm was reached, whereas the tool life of the cutting insert according to the invention made from the Y powder blend amounted to 9.6 min., which corresponds to a 50% increase.

Further cutting inserts of the SPGN120308F geometry, made from the X and Y powder blends, were subjected to a high temperature hardness test under the following cutting conditions:

Material of the workpiece: 50 CrV4 chrome vanadium steel

Cutting speed increasing from 80 to 120 m/min. in increments of 10 m/min. each

Cutting duration: 30 sec. each, for each cutting speed

Feed rate: 0.3 mm/revolution

Depth of cut: 2.0 mm

| Coolant: none | wear of flank face [mm] | |
|---|---|---|
| cutting speed [m/min.] | material X (prior art) | material Y |
| 80 | 0.15 | 0.12 |
| 90 | 0.24 | 0.16 |
| 100 | 0.34 | 0.21 |
| 110 | not reached | 0.27 |
| 120 | not reached | 0.32 |

Since tool temperatures rise as the cutting speed increases, the foregoing results immediately show that the known cutting inserts failed when a cutting speed of 100 m/min. was exceeded, whereas the cutting inserts manufactured from the sintered cemented carbide in accordance with the invention could be employed even at cutting speeds of up to 120 m/min. and still exhibited less wear even at such high cutting speeds than the cutting inserts made from the known cemented carbide at lower cutting speeds. The results of these metal cutting and high temperature hardness tests mean that the high temperature properties of the sintered cemented carbide in accordance with the invention are significantly better than those of the known sintered cemented carbide.

The difference between the cemented carbide grades X and Y compared with each other is the tantalum content of the grade in accordance with the invention (cf. Table 1), and hence the composition of the binder phase and the additional TaC phase visible by optical microscopy which is present only in the sintered cemented carbide grade in accordance with the invention.

EXAMPLE 2

Drills were manufactured from the V and W powder blends, only W leading to a sintered cemented carbide in accordance with the invention. The drills had a diameter of 8.5 mm, met the DIN 6537K standard [German Institute for Standardization] and were of the SE-B221 type. They had a PVD coating of TiN.

These drills were used for drilling under the following conditions:

Material of the workpiece: 42CrMo4V type chrome molybdenum steel

Cutting speed: 75 m/min.

Feed rate: 0.21 mm/revolution

Depth of hole: 30 mm

Use of an external coolant: yes

Results: The drills made from the sintered cemented carbide in accordance with the invention (material W) could be used to drill 2088 holes up to a wear of 0.15 mm.

Only 522 holes could be drilled using the conventional drills made from the material V, whereafter the cutting edge already featured chipped portions. This means an improvement of tool life by 1566 drilled holes, or 300%, which could be attained using the drills made from the sintered cemented carbide in accordance with the invention as compared with the prior art material.

EXAMPLE 3

Ball nose endmills having a diameter of 6 mm and each having a pair of cutting edges were manufactured from the I, J and M powder blends; the endmills had a PVD coating of TiAlN. They were used for working under the following conditions:

Workpiece material: No. 1.2379 steel, hardened up to a Rockwell C hardness of 55

Cutting speeds:
120 m/min. up to a milling length of 32 m
160 m/min, at a milling length of from 32 to 64 m
200 m/min. at a milling length of from 64 to 118 m
Feed rate per cutting edge: 0.12 mm
Depth of cut: 0.10 mm
Width of cut: 0.10 mm
Coolant: none
Results:

| | wear of flank face [mm] after: | | |
|---|---|---|---|
| | 32 m | 64 m | 118 m |
| Material I (prior art) | 0.07 | 0.08 | 0.13 |
| Material J | 0.03 | 0.05 | 0.07 |
| Material M | 0.06 | 0.09 | 0.10 |

These values also reveal a distinct improvement in the high temperature properties of the milling tools manufactured from the sintered cemented carbide in accordance with the invention in comparison with the conventional tools manufactured from material I.

EXAMPLE 4

Ball nose endmills each having a pair of cutting edges, a diameter of 6 mm and a PVD coating of TiAlN were manufactured from the J, K and H powder blends. These endmills were tested under the following conditions:

Workpiece material: No. 1.2379 steel, hardened up to a Rockwell C hardness of 55
Cutting speed: 160 m/min.
Feed rate per cutting edge: 0.10 mm
Depth of cut: 0.30 mm
Width of cut: 0.30 mm
Coolant: none
Results:

| | wear of flank face [mm] after: | | |
|---|---|---|---|
| | 14 m | 57 m | 100 m |
| Material J | 0.04 | 0.07 | 0.11 |
| material K | 0.04 | 0.06 | 0.12 |
| material H | 0.04 | 0.07 | 0.10 |

EXAMPLE 5

Ball nose endmills having a pair of cutting edges each and a diameter of 6 mm were manufactured from the I, J and M powder blends; the endmills had a PVD coating of TiAlN. These endmills were tested under the following conditions:

Workpiece material: No. 1.2379 steel, hardened up to a Rockwell C hardness of 62
Cutting speed: 70 m/min.
Feed rate per cutting edge: 0.12 mm
Depth of cut: 0.10 mm
Width of cut: 0.10 mm
Coolant: none
Results:

| | tool life [min.] maximum wear of flank face: 0.20 mm |
|---|---|
| material I (prior art) | 56 |
| material J | 80 |
| material M | 72 |

In this case, too, the tools manufactured from the sintered cemented carbide grades in accordance with the invention exhibit a significant improvement in the high temperature properties, namely, an improvement in tool life by 48 and 42%, respectively, as compared with the tools manufactured from conventional cemented carbide (material I).

The invention claimed is:

1. A fine grained sintered cemented carbide containing chromium, comprising a first phase based on tungsten carbide which is bound by means of a second phase of a metallic binder based on Co or CoNiFe, and of at least one additional phase comprising at least one carbide or mixed carbide of tantalum, the sintered cemented carbide contains approximately 0.3 to 4% Ta, as related to the total mass of the sintered cemented carbide, the tungsten carbide has a grain size of between about 0.1 and about 1.3 μm, the binder phase contains the metals W, Cr and Ta, dissolved in solid solution, and the at least one additional phase comprises a TaC phase visible by optical microscopy.

2. The sintered cemented carbide as claimed in claim 1, wherein the tungsten carbide has a grain size of between about 0.3 arid about 0.6 μm.

3. The sintered cemented carbide as claimed in claim 1 wherein the sintered cemented carbide contains approximately 0.8 to 1.2% Ta.

4. The sintered cemented carbide as claimed in claim 1 wherein the sintered cemented carbide contains up to 3 mass-% of the tungsten carbide is replaced by at least one hard component which is selected from the carbides, nitrides, carbonitrides, including their mixtures and solid solutions, of the metals Ti, Zr, Hf and Mo.

5. The sintered cemented carbide as claimed in claim 1 wherein up to 50 mass-% of the tantalum is replaced by niobium.

6. The sintered cemented carbide as claimed in claim 5, wherein the sintered cemented carbide contains approximately 0.4 to 0.6% Nb, as related to the total mass of the sintered cemented carbide.

7. The sintered cemented carbide as claimed in claim 5 wherein the binder phase additionally contains Nb, dissolved in solid solution.

8. The sintered cemented carbide as claimed in claim 5 wherein at least one additional phase comprises a (Ta, Nb)C phase visible by optical microscopy.

9. The sintered cemented carbide as claimed in claim 1 wherein the binder phase forms about 3 to about 18% of the total mass of the sintered cemented carbide.

10. The sintered cemented carbide as claimed in claim 9 wherein the binder phase contains up to about 20% tungsten, as related to its mass and dissolved in solid solution.

11. The sintered cemented carbide as claimed in claim 9 wherein the sintered cemented carbide has a Cr content of from about 1 to about 40%, as related to the total mass of the binder phase.

12. The sintered cemented carbide as claimed in claim 1 wherein the sintered cemented carbide additionally contains up to 8% V, as related to the total mass of the binder phase.

13. The sintered cemented carbide as claimed in claim 12 wherein the binder phase contains at least about 2% V.

14. The sintered cemented carbide as claimed in claim 12 wherein the binder phase additionally contains V, dissolved in solid solution.

15. The sintered cemented carbide as claimed in claim 12 wherein the at least one additional phase is visible by optical microscopy and comprises at least one of the (Ta, V)C and (Ta, Nb, V)C phases.

16. The sintered cemented carbide as claimed in claim 11 wherein the at least one additional phase comprises a (Cr, Co)-rich mixed carbide phase.

17. The sintered cemented carbide as claimed in claim 16 wherein the sintered cemented carbide contains approximately 17 to 30% Cr, as related to the total mass of the binder phase.

18. The sintered cemented carbide as claimed in claim 11 wherein the sintered cemented carbide contains approximately 6 to 12% Cr, as related to the total mass of the binder phase.

19. The sintered cemented carbide as claimed in claim 1 wherein the metals dissolved in the binder phase, with the exception of W, are dissolved in the binder phase in an amount corresponding to their respective solubility in the binder phase at room temperature.

20. The sintered cemented carbide as claimed in claim 1 wherein the sintered cemented carbide has a porosity of <A02.

21. The sintered cemented carbide as claimed in claim 1 further including a hard, wear-resistant coating applied by physical or chemical vapor deposition.

22. A cutting tool comprising a rake face and a flank face and comprising a cutting edge at the intersection of the rake face and the flank face, said cutting tool having a substrate wherein the substrate comprising a fine grained sintered cemented carbide containing chromium comprising a first phase based on tungsten carbide which is bound by means of a second phase of a metallic binder based on Co or CoNiFe, and of at least one additional phase comprising at least one carbide or mixed carbide of tantalum, the sintered cemented carbide contains approximately 0.3 to 4% Ta, as related to the total mass of the sintered cemented carbide, the tungsten carbide has a grain size of between about 0.1 and about 1.3 μm, the binder phase contains the metals W, CT and Ta, dissolved in solid solution, and the at least one additional phase comprises a TaC phase visible by optical microscopy.

23. The cutting tool as claimed in claim 22 wherein the cutting tool is one of a drill, a bit, a milling cutter, a part of such tools, a cutting insert and an indexable insert.

* * * * *